US012532970B2

(12) United States Patent
Totemeier et al.

(10) Patent No.: US 12,532,970 B2
(45) Date of Patent: Jan. 27, 2026

(54) EXTENDABLE SUPPORT FRAME FOR AN ARTICULATING BED PLATFORM

(71) Applicant: ERGOMOTION, INC., Goleta, CA (US)

(72) Inventors: Hunter Davis Totemeier, Fort Wayne, IN (US); Zhou Qing, Jiaxing Zhejiang (CN)

(73) Assignee: Ergomotion, Inc., Goleta, CA (US)

( * ) Notice: Subject to any disclaimer, the term of this patent is extended or adjusted under 35 U.S.C. 154(b) by 0 days.

(21) Appl. No.: 17/890,544

(22) Filed: Aug. 18, 2022

(65) Prior Publication Data

US 2023/0059199 A1 Feb. 23, 2023

Related U.S. Application Data

(60) Provisional application No. 63/235,710, filed on Aug. 21, 2021.

(51) Int. Cl.
*A47C 19/04* (2006.01)

(52) U.S. Cl.
CPC ..... *A47C 19/045* (2013.01)

(58) Field of Classification Search
CPC ..... A47C 31/008; A47C 20/041
USPC ..... 5/611
See application file for complete search history.

(56) References Cited

U.S. PATENT DOCUMENTS 3,593,350 A * 7/1971 Knight ..... A47C 20/041 5/616
4,449,262 A * 5/1984 Jahsman ..... A61G 13/06 5/616
4,494,259 A * 1/1985 Miller ..... A47C 20/08 5/616
4,541,134 A * 9/1985 Black ..... F16F 15/027 5/118
4,556,198 A * 12/1985 Tominaga ..... B66F 7/08 254/122
5,013,018 A * 5/1991 Sicek ..... A61G 13/02 5/601
5,299,334 A * 4/1994 Gonzalez ..... A61G 7/005 5/624
5,303,437 A * 4/1994 Hung ..... A61G 7/015 5/942

(Continued)

*Primary Examiner* — Amber R Anderson
*Assistant Examiner* — Luke Hall
(74) *Attorney, Agent, or Firm* — Bodman PLC

(57) ABSTRACT

An articulating bed incorporates a base frame having base side rails and a head end and a foot end, and a support frame having support side rails. An extension assembly including a carriage is carried by the base side rails. The carriage is mounted with wheels engaging the base side rails to translate from a first position through a range progressing toward the head end to a fully translated position and a scissor mechanism having at least one forward scissor assembly and at least one aft scissor assembly extended by the translation of the carriage to place the scissor mechanism in an extended position to elevate the support frame from the base frame. Abase shroud is engaged to the base frame. A telescoping shroud is engaged to the support frame and telescopically received within the base shroud with the scissor mechanism in a retracted position and extended from the base shroud with the scissor mechanism in the extended position.

10 Claims, 11 Drawing Sheets

(56) References Cited

U.S. PATENT DOCUMENTS 7,472,441 B1* 1/2009 Steffensmeier ..... A61G 13/04 606/244
2004/0068797 A1* 4/2004 Smith ..... A61G 13/0018 5/617
2005/0011005 A1* 1/2005 Borda ..... A47C 19/04 5/400
2005/0251915 A1* 11/2005 Elizondo ..... A47C 19/045 5/616
2005/0251916 A1* 11/2005 Elizondo ..... A47C 19/045 5/611
2006/0021143 A1* 2/2006 Lemire ..... A61G 7/012 5/611
2008/0276373 A1* 11/2008 Clenet ..... A47C 21/026 5/618
2008/0276838 A1* 11/2008 Roleder ..... A47C 19/22 108/26
2008/0301877 A1* 12/2008 Crocker ..... A61G 7/012 5/643
2009/0012634 A1* 1/2009 Koch ..... A47B 9/00 108/20
2009/0211028 A1* 8/2009 Richmond ..... A47C 20/08 5/717
2009/0282616 A1* 11/2009 Carr ..... A61G 7/012 5/611
2010/0017965 A1* 1/2010 Barthelt ..... A61G 7/053 5/611
2010/0050343 A1* 3/2010 Hornbach ..... A61G 13/06 5/611
2010/0056965 A1* 3/2010 Yeh ..... A47C 21/006 310/80
2010/0257671 A1* 10/2010 Shimada ..... A47C 19/045 5/611
2010/0325797 A1* 12/2010 Horne ..... B66F 7/0691 248/421
2013/0318720 A1* 12/2013 Connell ..... A61G 7/0506 5/658
2013/0340167 A1* 12/2013 Karwal ..... A61G 13/0009 5/81.1 R
2014/0041121 A1* 2/2014 Shan ..... A47C 21/006 5/618
2014/0059769 A1* 3/2014 Baker ..... A61G 7/015 5/613
2014/0203608 A1* 7/2014 Phillips ..... A47C 15/008 297/313
2015/0107024 A1* 4/2015 Xu ..... A47C 20/041 5/616
2015/0121623 A1* 5/2015 Huang ..... A61G 7/018 5/616
2016/0136018 A1* 5/2016 DeLuca ..... A61G 7/012 5/611
2016/0136022 A1* 5/2016 Johnson ..... A61G 7/08 5/611
2016/0161623 A1* 6/2016 Chacon ..... A47C 20/041 324/658
2018/0008049 A1* 1/2018 Shih ..... A47C 19/021
2018/0008052 A1* 1/2018 Krickeberg ..... A61G 15/10
2018/0132626 A1* 5/2018 He ..... A47C 20/041
2018/0242751 A1* 8/2018 MacNaughton ..... A47C 20/042
2019/0133331 A1* 5/2019 Kramer ..... A47C 19/025
2019/0191890 A1* 6/2019 Huang ..... A47C 20/10
2020/0022504 A1* 1/2020 Zhang ..... A47C 20/041
2020/0046133 A1* 2/2020 Huang ..... A47C 21/026
2020/0359806 A1* 11/2020 Wang ..... A47C 21/044
2020/0397147 A1* 12/2020 Ren ..... A47C 19/021
2021/0251390 A1* 8/2021 Goldsmith ..... A47C 19/14
2022/0133048 A1* 5/2022 Bellingroth ..... A47C 20/041 5/132
2022/0248864 A1* 8/2022 Shan ..... A47C 19/122

* cited by examiner

EXTENDABLE SUPPORT FRAME FOR AN ARTICULATING BED PLATFORM

REFERENCES TO RELATED APPLICATIONS

This application claims priority of U.S. provisional application 63/235,710 filed on Aug. 21, 2021, having the same title and a common assignee with the present application, the disclosure of which is incorporated herein by reference. This application is with US design application 29804486 filed on Aug. 20, 2021 entitled EXTENDING INSET BASE DESIGN FOR AN ARTICULATING BED, having a common assignee with the present application, the disclosure of which is incorporated herein by reference.

BACKGROUND

Field

This invention relates generally to the field of adjustable beds and more particularly to a structure for an articulating bed having support frame for an articulating platform, the support frame extendible from a base frame and incorporating dual interconnected scissored leg pairs. A telescoping shroud attached to the support frame is received in a base shroud attached to the base frame for concealing the actuating structures in both the extended and retracted positions of the support frame.

Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

The mechanical structure and drive mechanisms for such articulating beds must be able to support the weight of both a mattress and the occupant. Due to the size, weight, fabrication materials and configuration of the mattress and supporting structure, maintaining rigidity in the system may also be challenging. Typical articulating beds provide an upper body positioning element and a thigh and lower leg positioning element either individually active or with combined actuation.

However, modern articulating beds for aging users may require differing heights of the articulating platform for ingress and egress from the bed. While hospital beds often have an elevating mechanism, these mechanisms are unattractive and bulky It is therefore desirable to provide an articulating bed having an extendible articulation platform while aesthetically shielding the actuation mechanisms of the bed.

SUMMARY

The embodiments disclosed herein overcome the shortcomings of the prior art by providing an articulating bed incorporating a base frame having base side rails and a head end and a foot end, and a support frame having support side rails. An extension assembly including a carriage is carried by the base side rails. The carriage is mounted with wheels engaging the base side rails to translate from a first position through a range progressing toward the head end to a fully translated position and a scissor mechanism having at least one forward scissor assembly and at least one aft scissor assembly extended by the translation of the carriage to place the scissor mechanism in an extended position to elevate the support frame from the base frame. A base shroud is engaged to the base frame. A telescoping shroud is engaged to the support frame and telescopically received within the base shroud with the scissor mechanism in a retracted position and extended from the base shroud with the scissor mechanism in the extended position.

BRIEF DESCRIPTION OF THE DRAWINGS

These and other features and advantages of the present invention will be better understood by reference to the following detailed description of exemplary implementations when considered in connection with the accompanying drawings wherein.

DETAILED DESCRIPTION

Figure 1:
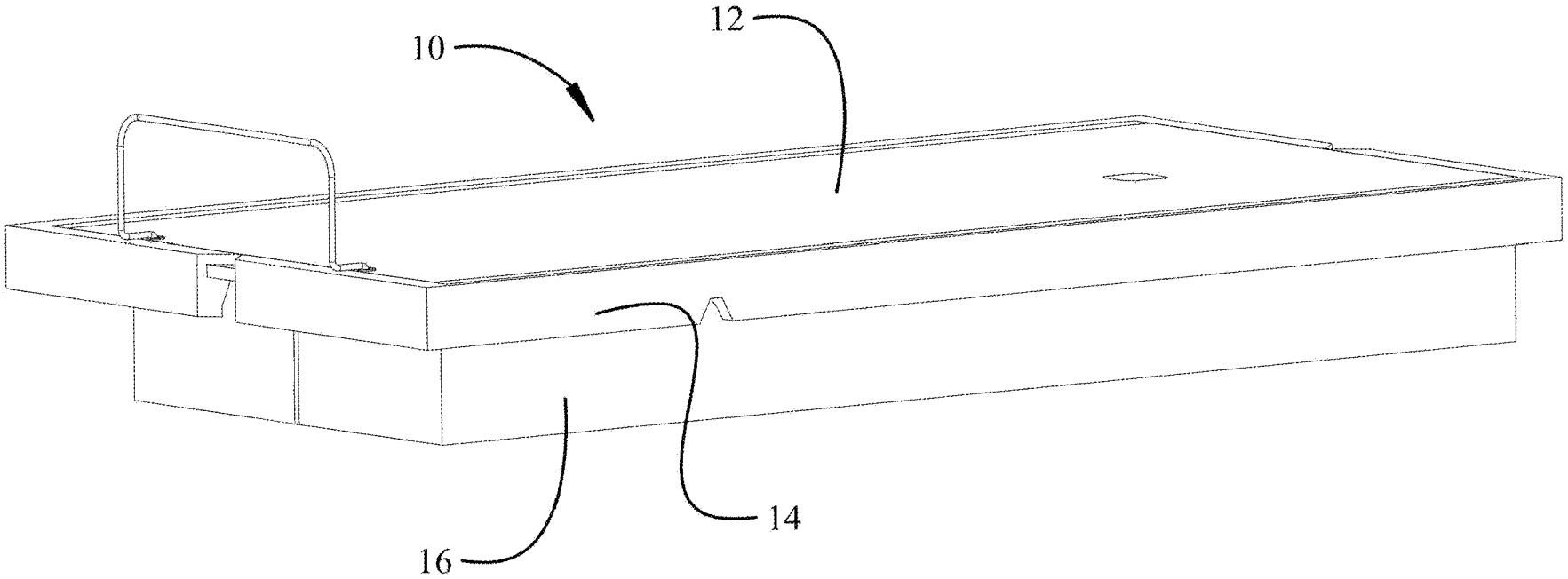
FIG. 1 is a perspective view of an example implementation with the support frame in a retracted position.

Embodiments shown in the drawings and described herein provide a support frame for an articulating platform, the support frame extendible from a base frame and incorporating an extension assembly with dual interconnected scissored leg pairs. A telescoping shroud attached to the support frame is received in a base shroud attached to the base frame for concealing the actuating structures in both the extended and retracted positions of the support frame.

Figure 2:
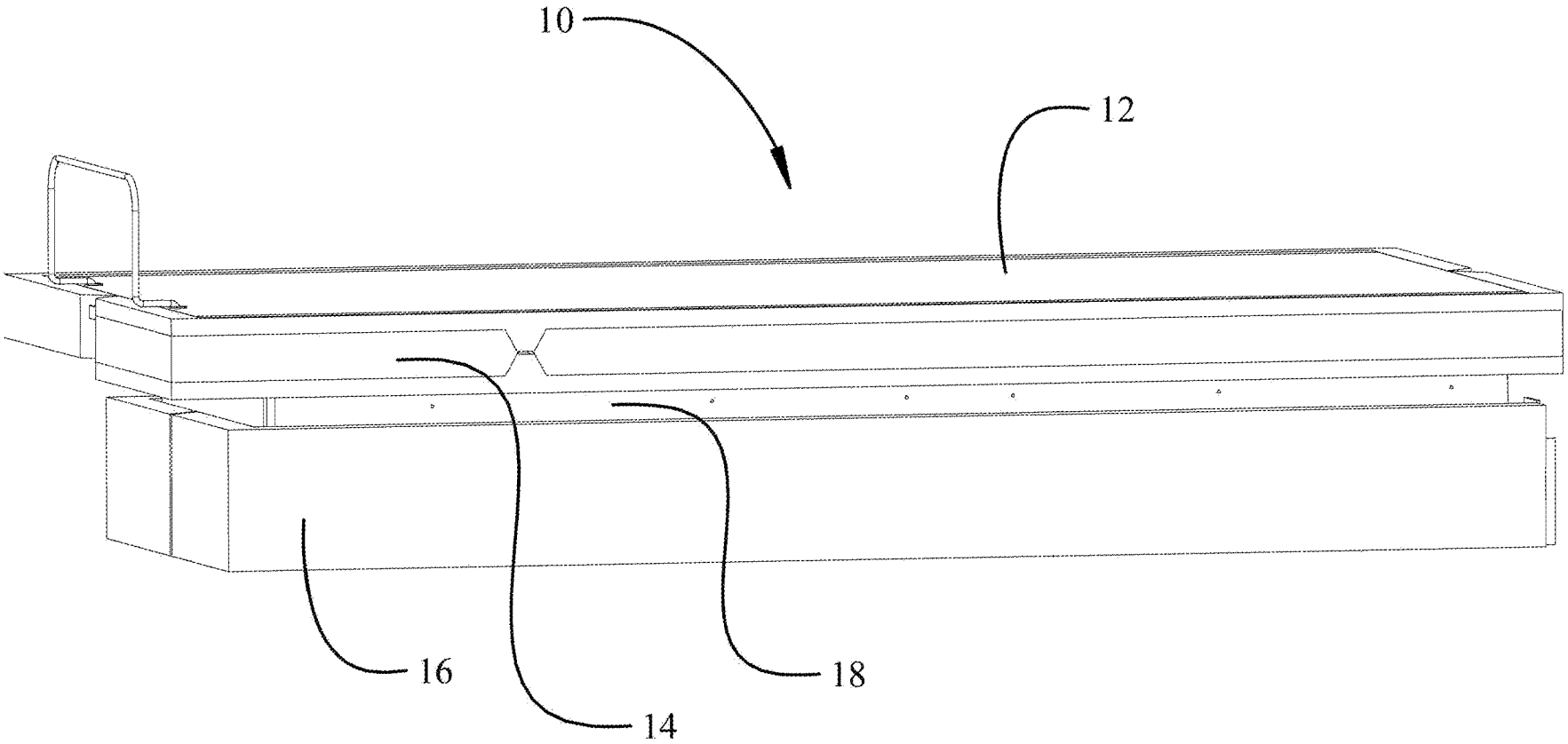
FIG. 2 is a perspective view of the example implementation with the support frame in an extended position.

Referring to the drawings, FIG. 1 illustrates an exemplary implementation of an adjustable bed 10 with an extendable articulating support frame in the retracted position. An mattress support platform 12 includes a surround 14. A base frame, to be described in greater detail subsequently, has an attached base shroud 16. FIG. 2. Shows the adjustable bed 10 in the extended position with a telescoping shroud 18 which is attached to an articulating system support frame, to be described in greater detail subsequently.

Figure 3A:
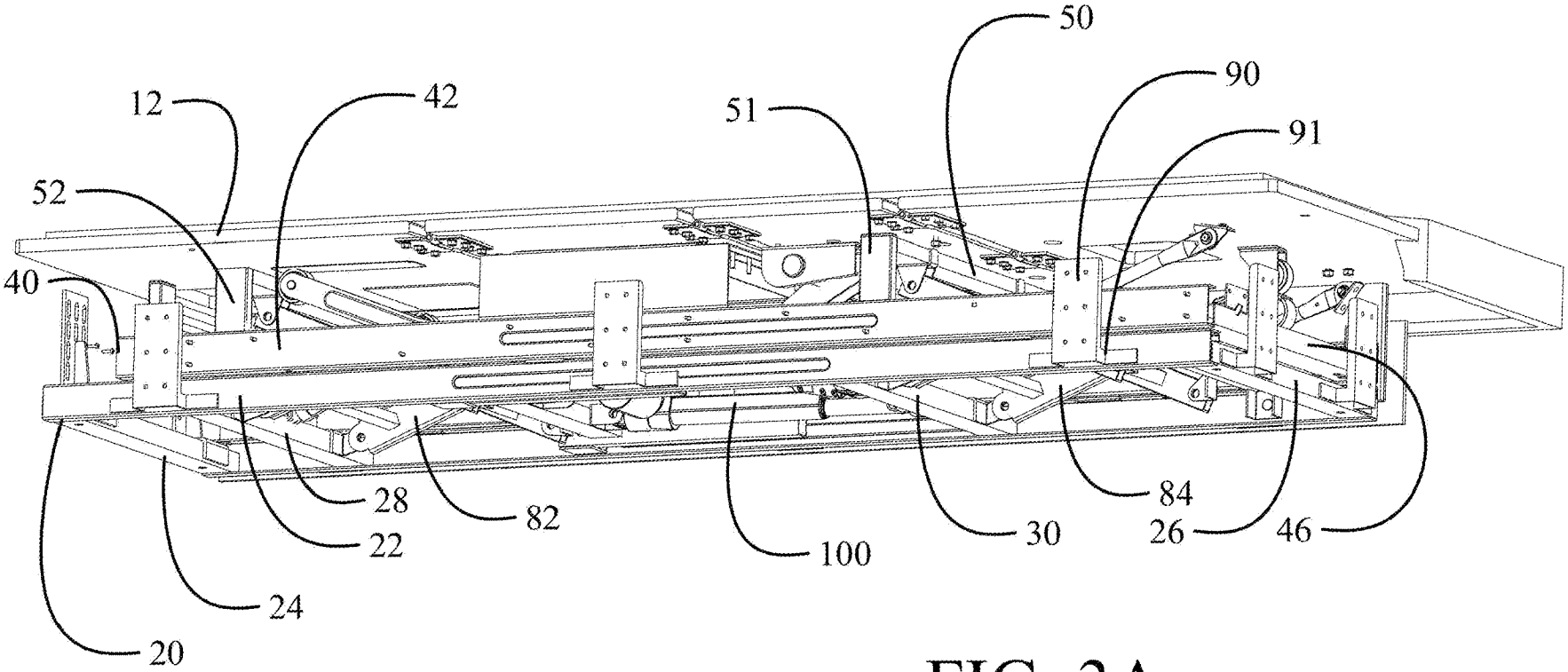
FIG. 3A is a side upward perspective view of the example implementation with the support frame in the retracted position.
Figure 4A:
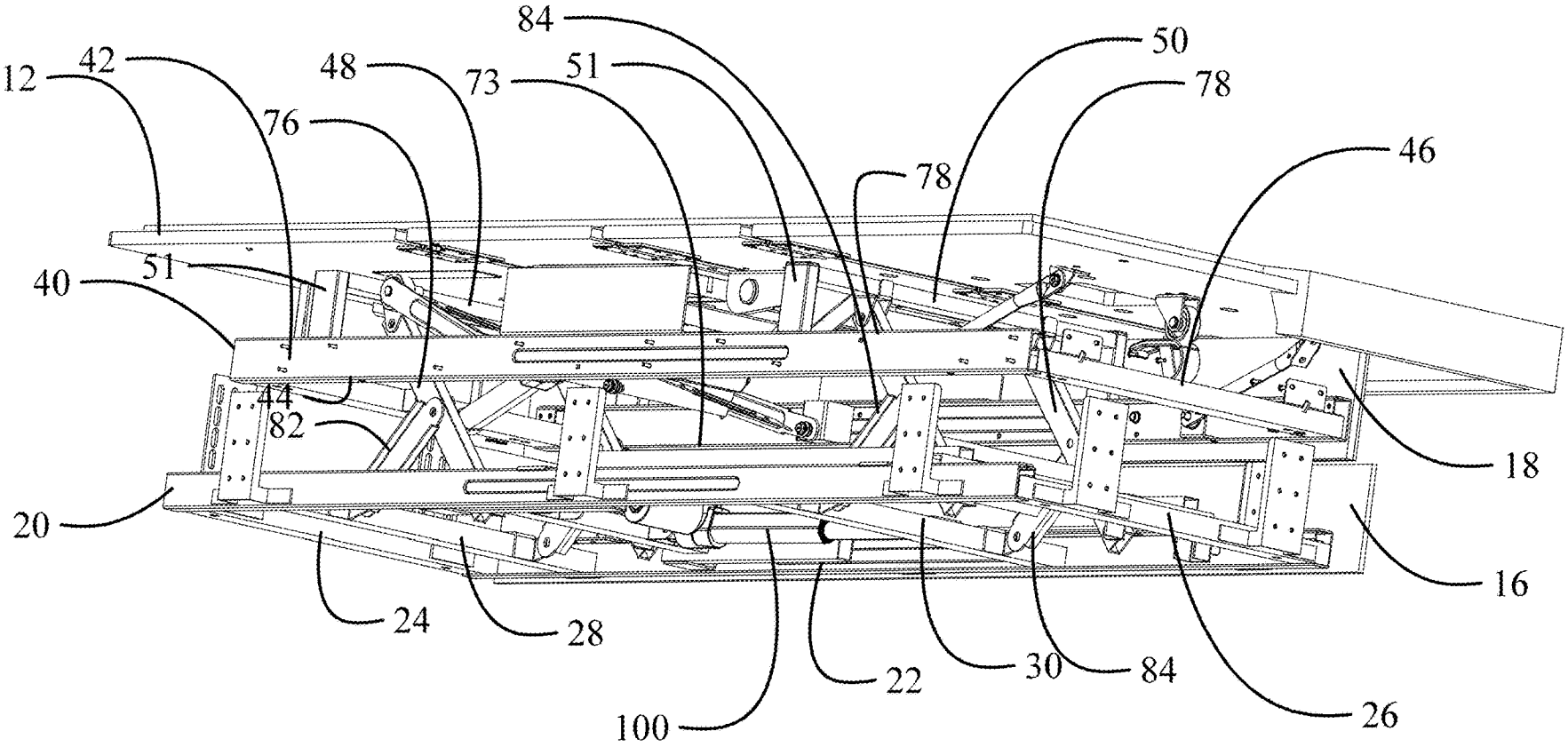
FIG. 4A is a side upward perspective view of the example implementation with the support frame in the extended position.

FIGS. 3A and 4A show details of a base frame 20 and an articulating system support frame 40 in the retracted and extended positions with the base shroud and telescoping shroud removed for clarity. The base frame 20 incorporates base side rails 22, a base head rail 24, and a base foot rail 26 connected between the base side rails. A head end intermediate rail 28 and a foot end intermediate rail 30 extend. between the base side rails 22.

The articulating system support frame 40 incorporates support side rails 42, a support head rail 44 and a support foot rail 46. A head end suspension rail 48 and a foot end suspension rail 50 are mounted with brackets 51 to extend upwardly from the support side rails 42 as mounting elements for the extension assembly, to be described in greater detail subsequently.

The articulating system 60 includes an upper body support 62, seat support 64, thigh support 66 and lower leg support 68, combined to provide the mattress support platform 12. The upper body support 62 and thigh support 66 are attached to the head edge and foot edge of the seat support with hinges and the lower leg support is attached with hinges to the thigh support. Articulation of the upper body support 62 and thigh support 66 is accomplished with actuators 71 and 72 and associated mechanisms as described, for example, in U.S. Ser. No. 10/463,551 the disclosure of which is incorporated herein by reference. The articulating system is support from the articulating system support frame 40.

Figure 3B:
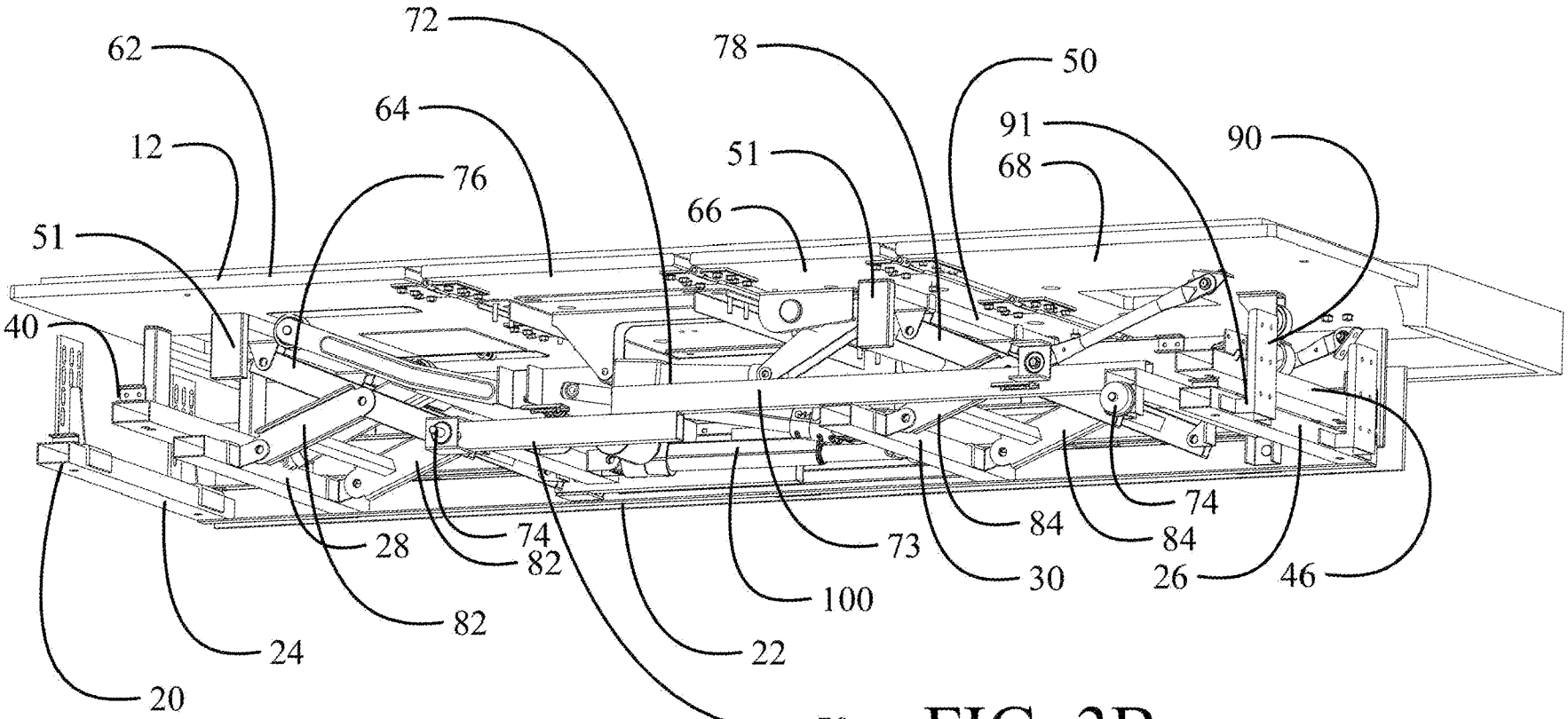
FIG. 3B is a side upward perspective view of the example implementation in the retracted position with the side frame elements of the base frame and support frame removed for clarity.
Figure 4B:
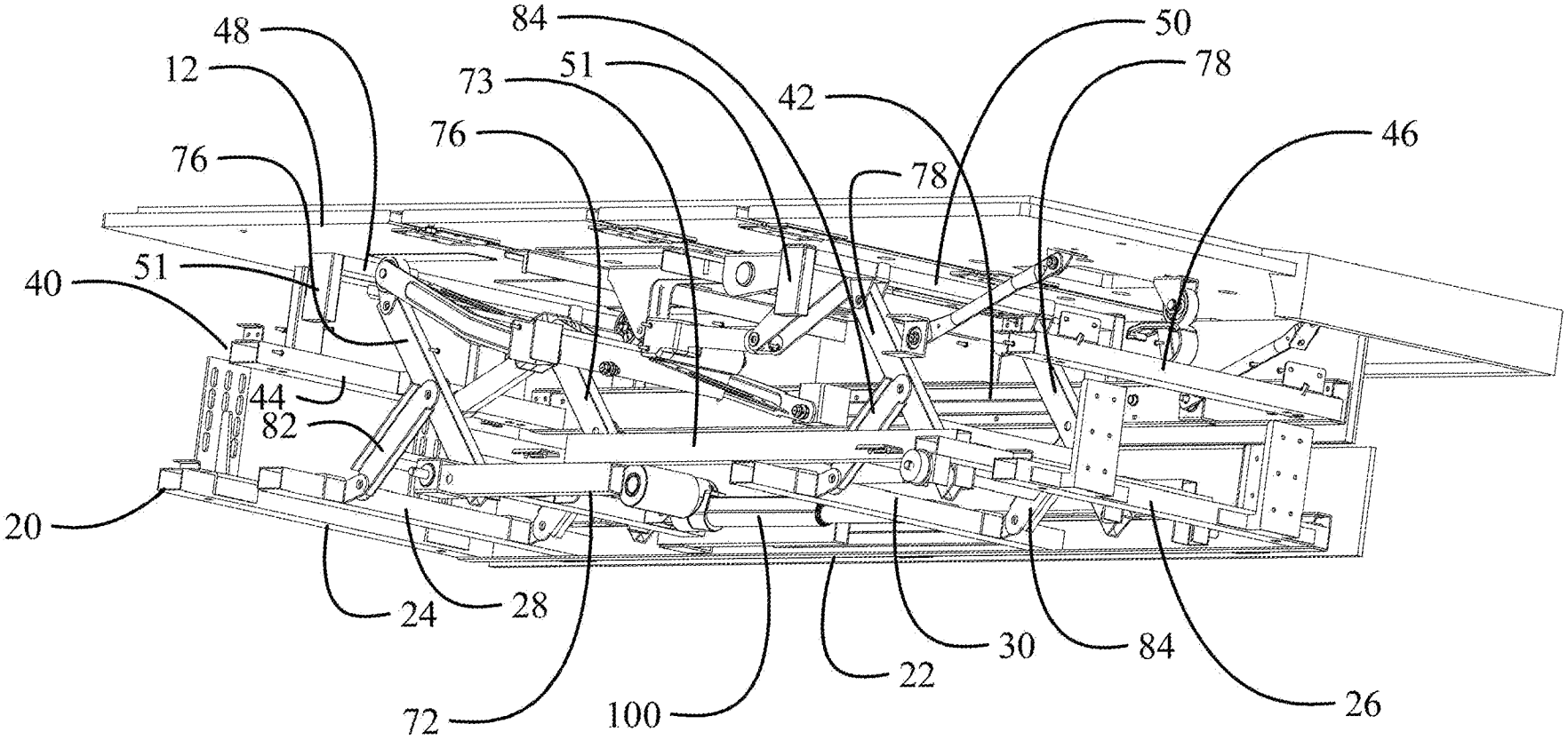
FIG. 4B is a side upward perspective view of the example implementation in the extended position with the side frame elements of the base frame and support frame removed for clarity.
Figure 5:
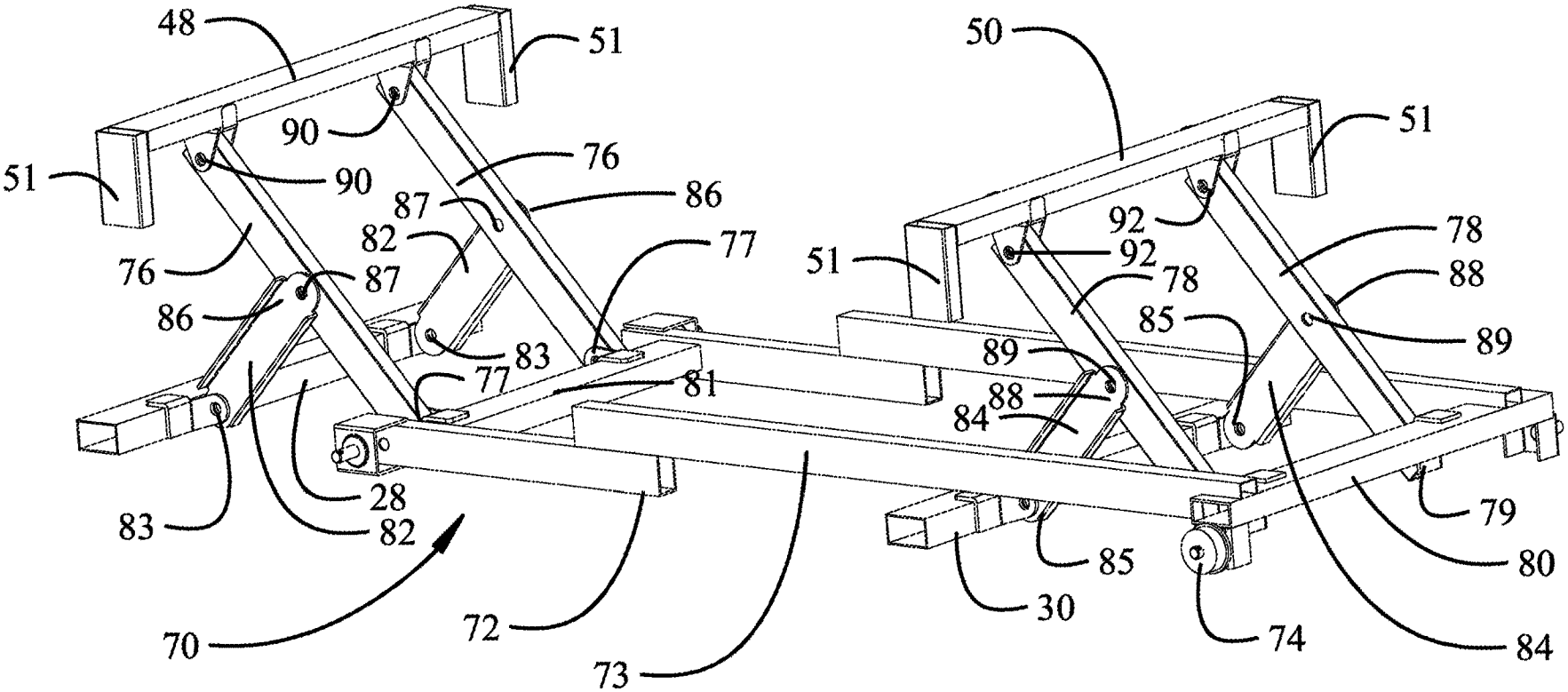
FIG. 5 is a detailed view of the extension assembly.

As seen in FIGS. 3B and 4B and in detail in FIG. 5, an extension assembly 70 is provided to extend the articulating system support frame 40 upwards from the base frame 20. Upward extension allows for easy ingress and egress from the bed particularly for aging users. An extension carriage 72 has carriage sides 73 supported by wheels 74 in the base side rails 22. A scissor mechanism 75 includes a pair of forward first scissor legs 76 pivotally attached at a first end 77 to a head end cross member 81 on the carriage 72 and a pair of aft first scissor legs 78 pivotally attached at a first end 79 to a foot end crossmember 80 on the carriage 72. A pair of forward second scissor legs 82 are pivotally attached at a forward end 83 to the head end intermediate rail 28 of the base frame 20 and a pair of aft second scissor legs 84 are pivotally attached at a forward end 85 to the foot end intermediate rail 30. The forward second scissor legs are pivotally attached at an aft end 86 to the forward first scissor legs proximate a midpoint 87 while the aft second scissor legs are pivotally attached at an aft end 88 to the aft first scissor legs proximate a midpoint 89. The forward first scissor legs 76 are pivotally attached at a second end 90 to the head end suspension rail 48 of the support frame 40 and the aft first scissor legs 78 are attached at a second end 93 to the foot end suspension rail 50. The forward and aft first scissor legs combine for a forward scissor assembly and the forward and aft second scissor legs combine for an aft scissor assembly.

Translation of the extension carriage 72 by an actuator 100 from an initial position shown in FIGS. 3A and 3B toward the head end results in closure of the forward first scissor legs 76 and aft first scissor legs 78 and forward second scissor legs 82 and aft second scissor legs 84 resulting in elevation of the second ends of the first scissor legs elevating the suspension rails 50 and the attached support frame 40 to the position shown in FIGS. 4A, 4B and 5. Rigid interconnection of the head end cross member 81 and foot end crossmember 80 maintains paired motion of the scissor pairs to constrain the support frame in a horizontal position at all levels of extension.

Figure 6A:
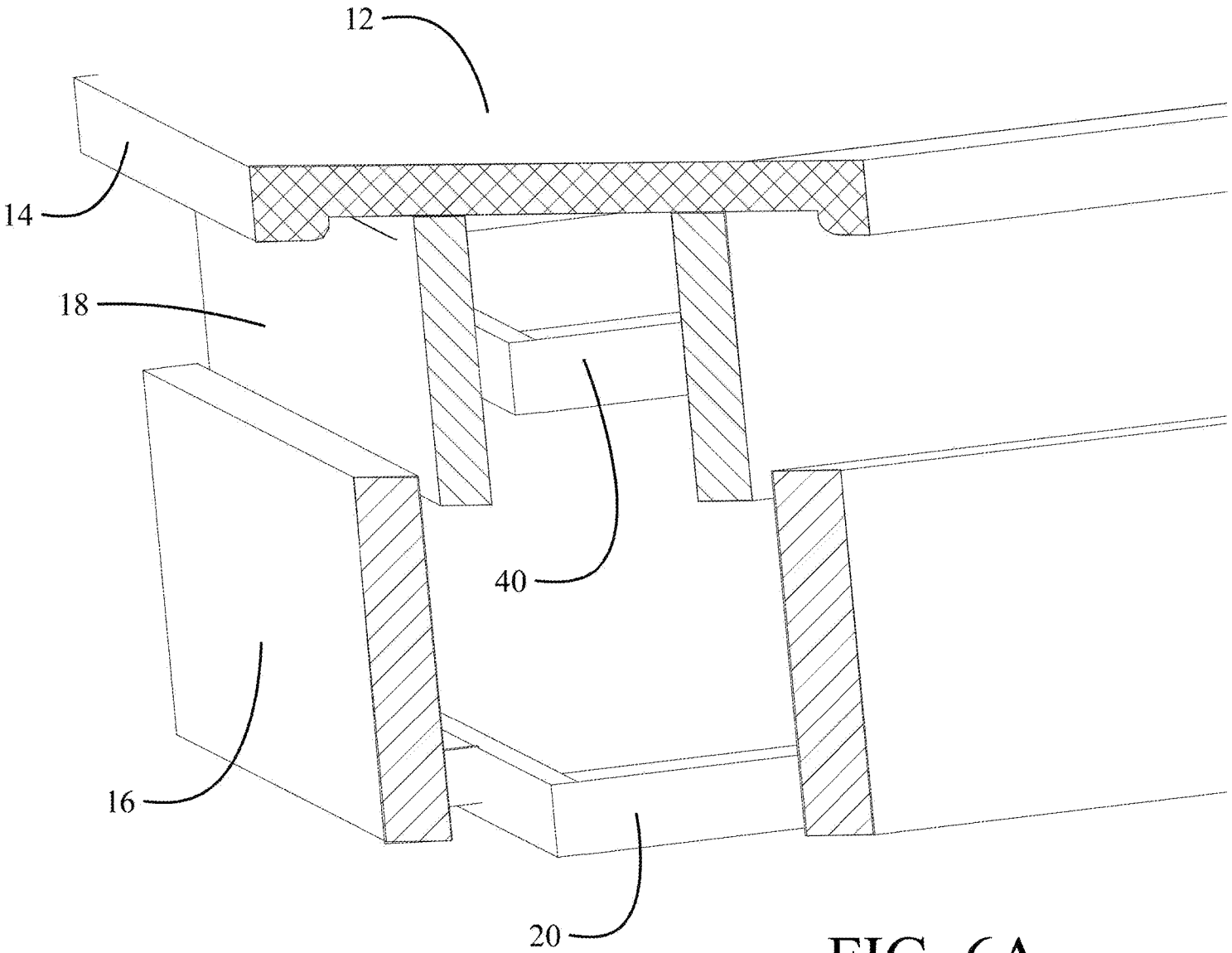
FIG. 6A is a corner perspective section view showing the telescoping shroud and base shroud supported by the support frame and base frame in the extended position.
Figure 6B:
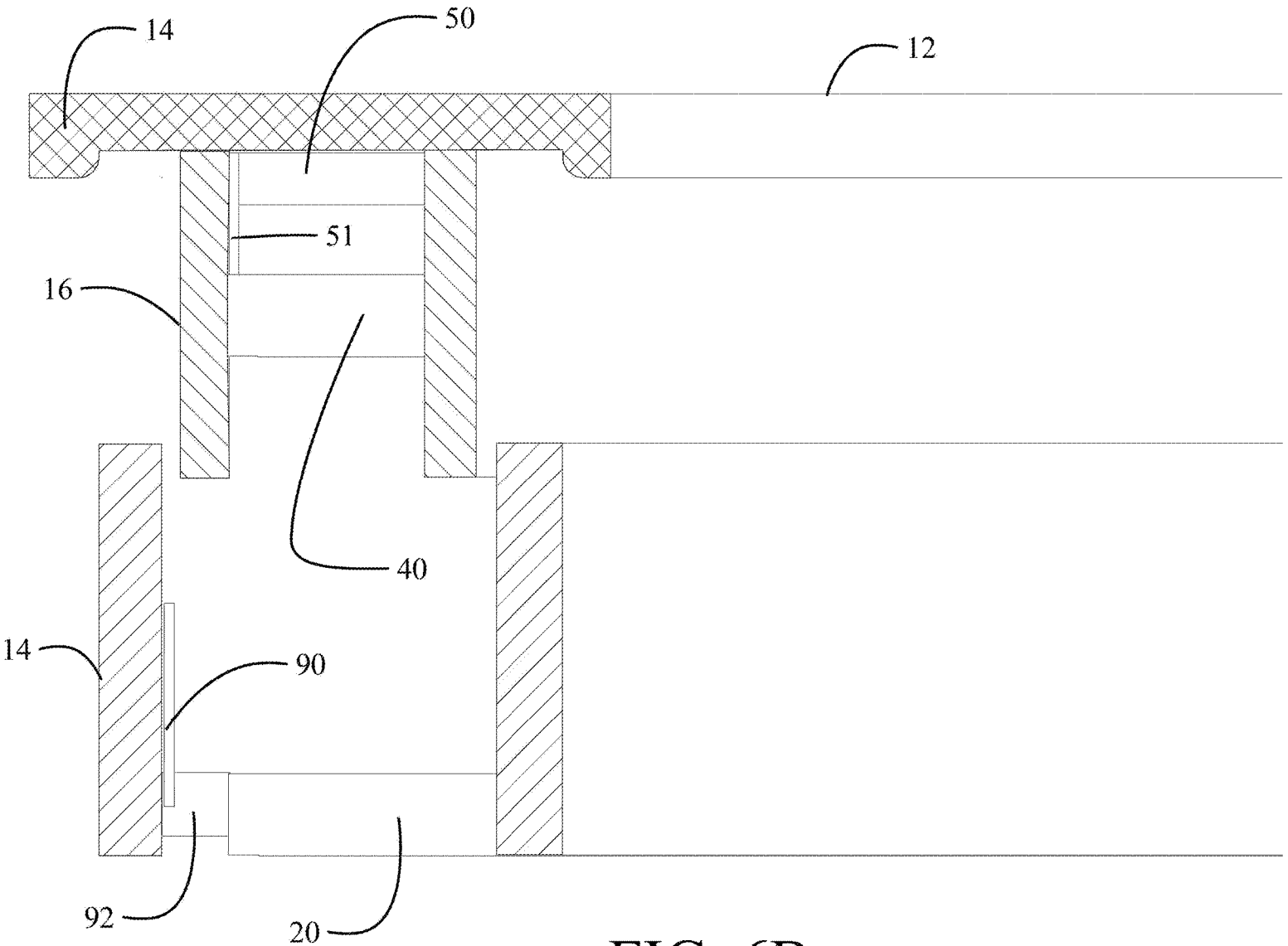
FIG. 6B is a corner section view from the side showing the telescoping shroud and base shroud supported by the support frame and base frame in the extended position.
Figure 7A:
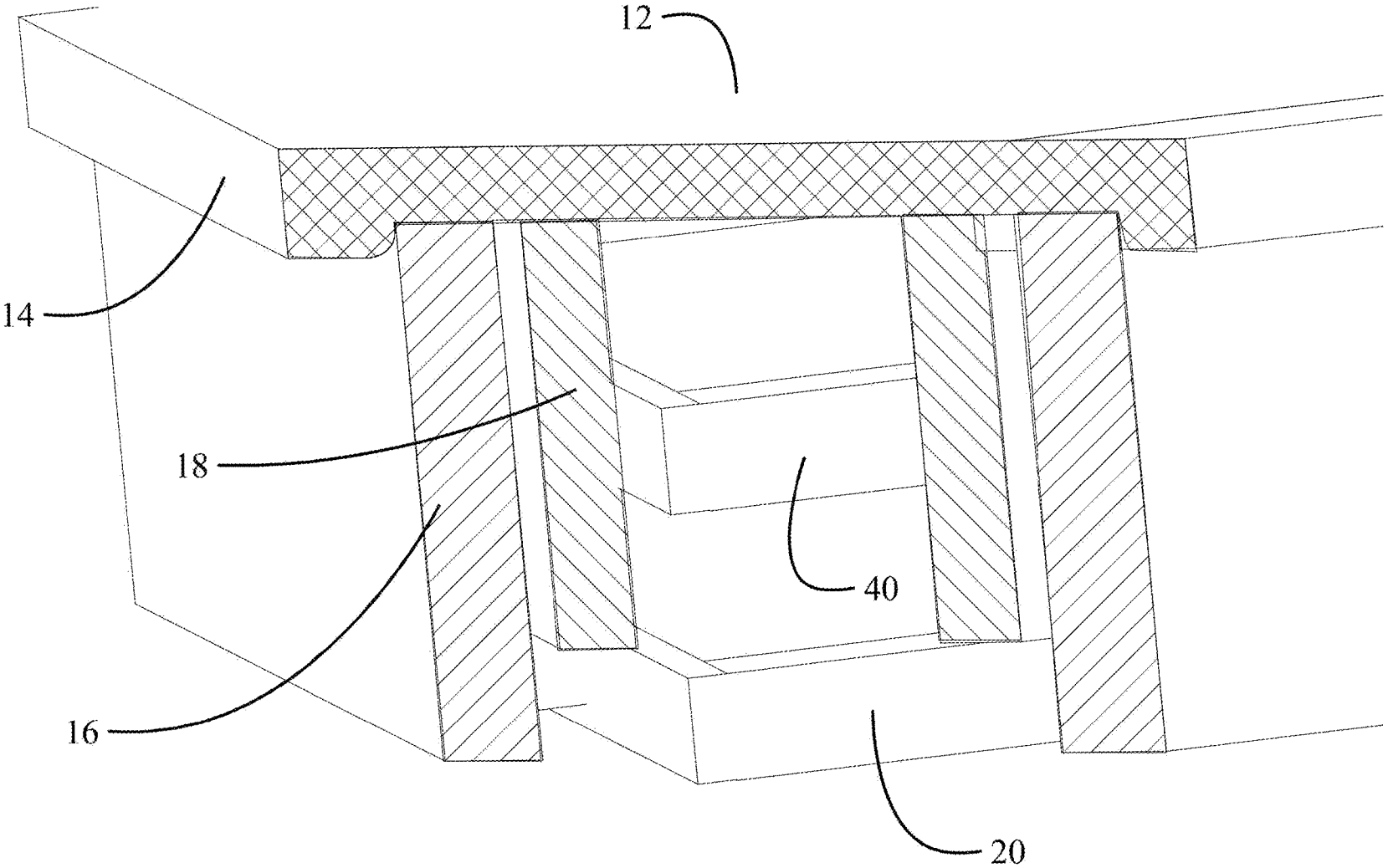
FIG. 7A is a corner perspective section view showing the telescoping shroud and base shroud supported by the support frame and base frame in the retracted position.
Figure 7B:
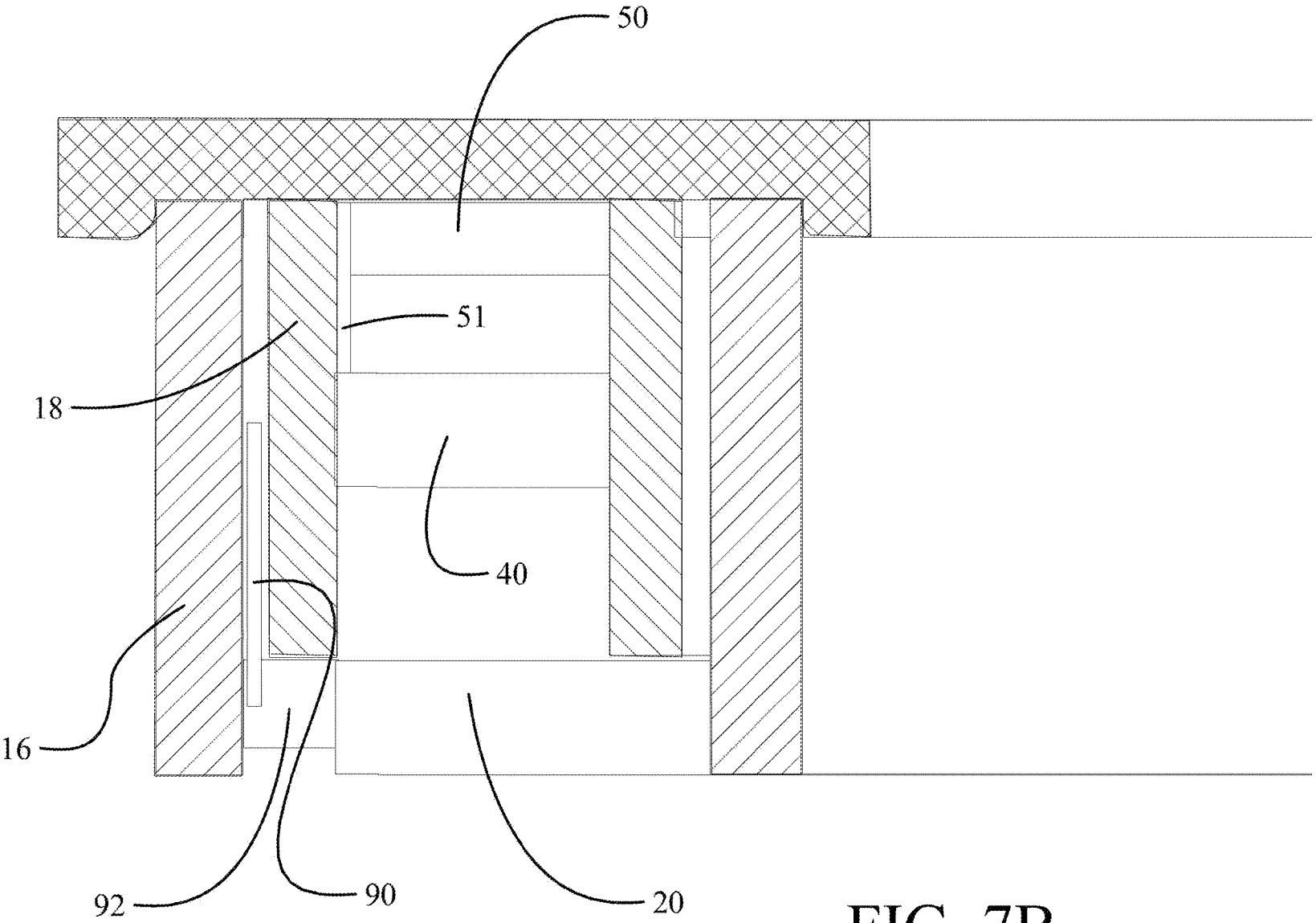
FIG. 7B is a corner section view from the side showing the telescoping shroud and base shroud supported by the support frame and base frame in the retracted position.

The scissored extension assembly 70 and the actuators and associated structure of the articulation system are shielded from view and protected from intrusion by a telescoping shroud system incorporating the base shroud 16 attached to the base frame 20 and the telescoping shroud 18 attached to the extendible articulating system support frame 40. As seen in FIGS. 6A and 6B, the base shroud is attached to the base frame 20 with vertical brackets 91 which are spaced from the base frame 20 by arms 92. The telescoping shroud 18 is secured to the support frame 40 with additional vertical support provided by the brackets 51 extending to the suspension rails 50, 52. Width of the telescoping shroud is defined to allow the telescoping shroud to be received between an inner surface of the base shroud and the base frame as seen in FIGS. 7A and 7B. The retracted elevating assembly places the surround 14 on the platform 12 substantially flush or nested with the top of the base shroud 16.

Raving now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. An articulating bed comprising:

a base frame having base side rails spanning longitudinally between a head end and a foot end of the base frame;

a mattress support platform;

a support frame supporting the mattress support platform above the base frame and having support side rails spanning longitudinally between the head and foot ends in parallel alignment with the base side rails;

an extension assembly arranged between the base frame and the support frame and configured to raise and lower the mattress support platform relative to the base frame, the extension assembly comprising:

a carriage having at least two wheels movably engaged with each of the base side rails at spaced longitudinal locations, said carriage configured to translate along the base side rails from a first position to a second position, a pair of forward scissor assemblies each having a forward first scissor leg pivotally attached to a forward second scissor leg and each forward scissor assembly pivotally connected between the support frame, the base frame, and the carriage, and a pair of aft scissor assembly assemblies each having an aft first scissor leg pivotally attached to an aft second scissor leg and each aft scissor assembly pivotally connected between the support frame, the base frame, and the carriage, wherein the pairs of forward and aft scissor assemblies are configured to extend from a retracted position with the carriage in the first position to an extended position by moving the carriage to the second position to elevate the support frame from the base frame; and a shroud system comprising a base shroud engaged to the base frame a telescoping shroud engaged to the support frame, wherein the telescoping shroud is telescopically received within the base shroud with the extension assembly in the retracted position and telescopically extended from the base shroud with the extension assembly in the extended position.

2. The articulating bed of claim 1, wherein the base frame comprises the base side rails and a base head rail and a base foot rail connected between the base side rails, with a head end intermediate rail and a foot end intermediate rail extend extending-between the base side rails.

3. The articulating bed of claim 2, wherein the support frame further comprises a support head rail and a support foot rail extending between the support side rails, a head end suspension rail and a foot end suspension rail mounted with brackets to extend upwardly from the support side rails to support the mattress support platform.

4. The articulating bed of claim 3, wherein the pair of forward first scissor legs are pivotally attached at a first end to a head end cross member on the carriage and the pair of aft first scissor legs are pivotally attached at a first end to a foot end crossmember on the carriage.

5. The articulating bed of claim 4, wherein the base shroud is attached to the base frame with vertical brackets spaced from the base frame by arms and the telescoping shroud is secured to the support frame and the brackets extending from the support frame to the suspension rails, the telescoping shroud having a width configured to allow the telescoping shroud to be received within an inner surface of the base shroud.

6. The articulating bed of claim 4, wherein the forward second scissor legs are pivotally attached at a forward end proximate to the head end of the base frame, and wherein the aft second scissor legs are pivotally attached at a forward end proximate to the foot end of the base frame.

7. The articulating bed of claim 6, wherein the forward second scissor legs are pivotally attached at an aft end to the forward first scissor legs proximate a midpoint of the forward first scissor legs, and wherein the aft second scissor legs are pivotally attached at an aft end to the aft first scissor legs proximate a midpoint of the aft first scissor legs.

8. The articulating bed of claim 7, wherein the forward first scissor legs are pivotally attached at a second end to the head end suspension rail of the support frame, and wherein the aft first scissor legs are pivotally attached at a second end to the foot end suspension rail of the support frame.

9. The articulating bed of claim 8, further comprising an actuator configured to translate the carriage toward the head end resulting in simultaneous closure of the forward first scissor legs and aft first scissor legs proximate the head end and the forward second scissor legs and aft second scissor legs proximate the foot end, resulting in elevation of the second ends of the forward and aft first scissor legs.

10. An articulating bed comprising:

a base frame having base side rails spanning longitudinally between a head end and a foot end of the base frame;

a mattress support platform suspended over the base frame;

a support frame supporting the mattress support platform;

an extension assembly arranged between the base frame and the support frame and configured to raise and lower the mattress support platform relative to the base frame, the extension assembly comprising:

a carriage having two wheels movably engaged with each of the base side rails at spaced longitudinal locations, said carriage configured to translate along the base side rails from a first position to a second position, a pair of forward scissor assemblies each having a forward first scissor leg pivotally attached to a forward second scissor leg and each forward scissor assembly pivotally connected between the support frame and the base frame, wherein a lower end of the forward first legs are pivotally connected to the carriage, and a pair of aft scissor assemblies each having an aft first scissor leg pivotally attached to an aft second scissor leg and each aft scissor assembly pivotally connected between the support frame and the base frame, wherein a lower end of the aft first legs are pivotally connected to the carriage, and wherein movement of the carriage from the first position to the second position simultaneously extends the pairs of forward and aft scissor assemblies from a retracted position to an extended position that elevates the support frame from the base frame; an actuator configured to translate the carriage between the first and second positions;

a base shroud engaged to the base frame and a telescoping shroud engaged to the support frame; wherein the telescoping shroud is received within the base shroud with the extension assembly in the retracted position and telescopically extended from the base shroud with the extension assembly in the extended position.

* * * * *